United States Patent [19]

Ramachandran

[11] 4,140,641

[45] Feb. 20, 1979

[54] CONCENTRATED LIQUID DETERGENT WITH FABRIC SOFTENER

[75] Inventor: Pallassana Ramachandran, Robbinsville, N.J.

[73] Assignee: Colgate-Palmolive Company, New York, N.Y.

[21] Appl. No.: 887,788

[22] Filed: Mar. 17, 1978

[51] Int. Cl.[2] ..... D06M 13/36

[52] U.S. Cl. ..... 252/8.75; 252/8.7; 252/8.8

[58] Field of Search ..... 252/8.75, 8.7, 8.8

[56] References Cited

U.S. PATENT DOCUMENTS

| | | | |
|---|---|---|---|
| 3,537,993 | 11/1970 | Coward | 252/8.75 |
| 3,681,241 | 8/1972 | Rudy | 252/8.75 |
| 3,849,435 | 11/1974 | Diery et al. | 252/8.75 |
| 3,920,565 | 11/1975 | Morton | 252/8.75 |
| 3,951,879 | 4/1976 | Wixon | 252/8.8 |
| 3,959,157 | 5/1976 | Inamorate | 252/8.75 |
| 3,974,076 | 8/1976 | Wiersema et al. | 252/8.75 |

*Primary Examiner*—William E. Schulz

*Attorney, Agent, or Firm*—Herbert S. Sylvester; Murray M. Grill; Norman Blumenkopf

[57] ABSTRACT

A highly concentrated single phase liquid detergent composition containing fabric softener is formulated from a nonionic surfactant and an imidazolinium quaternary ammonium fabric softener.

9 Claims, No Drawings

CONCENTRATED LIQUID DETERGENT WITH FABRIC SOFTENER

BACKGROUND OF THE INVENTION

This invention relates to detergent compositions having superior detergent and fabric softening properties. In the fabric softening art, it is well known to prepare fabric softening formulations which are adapted for use in the rinse cycle of conventional home-laundry washing machines. As a general rule, any one of a wide variety of softening agents may be used, and they are normally formulated as dispersions in water containing from about 4% to about 7% of the active ingredients.

It has been recognized for some time that it would be desirable as a matter of convenience to employ the fabric softening formulation concurrently with the detergent in the wash cycle of the washing machine. In many of the home laundry washing machines now in use, the machine is so designed that in order to use a rinse cycle fabric softener it is necessary for the housewife to watch the cycle carefully, and to interrupt the cycle just before the final washing step to add the fabric softening agent, because no special provision has been made for dispensing fabric softeners at the time of the final rinse. The use of fabric softeners in such machines manifestly would be made considerably more convenient if it were possible for the housewife to add the fabric softener together with the laundry detergent, whereby the softener would act concurrently with the detergent simultaneously to wash and to soften the fabrics.

Conventional fabric softening formulations can be used as wash-cycle softeners. However, in order to obtain a reasonable amount of softening it is necessary to use generally in the order of twice the normal amount of formulation. Because this would require the housewife to maintain large quantities of fabric softening formulations on her shelves, and would involve an apparently wasteful use of fabric softeners, housewives are reluctant to employ the fabric softening formulations currently available as washcycle softeners.

To overcome this difficulty, it would be desirable to provide a concentrated composition containing both detergent and fabric softener which, when used in a small quantity, would provide effective cleaning and softening of fabrics in the home laundry machine. For this purpose, a formulation having a very high concentration of active ingredients would be needed. It has not been possible heretofore to prepare one-phase liquid compositions employing the commercially accepted fabric softeners and detergents available. The generally effective fabric softeners which have found widespread commercial acceptance, such as the di-(higher alkyl)-di-(lower alkyl) ammonium salts, cannot be formulated into one-phase liquid compositions which are stable at high concentrations. Using the typical commercially available fabric softening agents, formulations containing a maximum of 7% to 8% active ingredient can be prepared without incurring stability difficulties.

SUMMARY OF THE INVENTION

A highly concentrated single phase liquid detergent composition containing fabric softener has been formulated using a nonionic surfactant and a quarternary imidazolinium fabric softener. The product is recommended for use at levels of ⅛ cup per washload, which is half the amount generally required for concentrated liquid laundry detergents.

The nonionic surfactants for use in compositions according to the present invention are commercially known and comprise the water soluble products which are derived from the condensation of an alkylene oxide or equivalent reactant and a reactive-hydrogen hydrophobe. The hydrophobic organic compounds may be aliphatic, aromatic, or heterocyclic, although the first two classes are preferred. The preferred types of hydrophobes are higher aliphatic alcohols and alkyl phenols, although others may be used such as carboxylic acids, carboxamides, mercaptans, sulfonamides, etc. The ethylene oxide condensates with higher aliphatic alcohols represent a preferred class of nonionic compounds. Usually the hydrophobic moiety should contain at least about 6 carbon atoms and preferably at least about 8 carbon atoms, and may contain as many as about 50 carbon atoms or more. The amount of alkylene oxide will vary considerably depending upon the hydrophobe, but as a general rule at least about 5 moles of alkylene oxide per mole of hydrophobe should be used. The upper limit of alkylene oxide will vary also, but no particular criticality can be ascribed thereto. As much as 200 or more moles of alkylene oxide per mole of hydrophobe may be employed. While ethylene oxide is the preferred and predominating oxyalkylating agent, other lower alkylene oxides such as propylene oxide, butylene oxide, and the like may be used or substituted in part for the ethylene oxide.

Other nonionic compounds which are suitable are the polyoxyalkylene esters of the organic acids such as the higher fatty acids, the resin acids, tall oil acids, acids from petroleum oxidation products, etc. These esters will usually contain from about 10 to about 22 carbon atoms in the acid moiety and from about 12 to about 30 moles of ethylene oxide or its equivalent.

Still other nonionic surfactants are the alkylene oxide condensates with the higher fatty acid amides. The fatty acid group will generally contain from about 8 to about 22 carbon atoms, and this will be condensed with about 10 to about 50 moles of ethylene oxide. The corresponding carboxamides and sulfonamides may also be used as substantial equivalents.

The oxyalkylated higher aliphatic alcohols are the preferred nonionic surfactants for compositions according to the present invention. The fatty alcohols should contain at least 6 carbon atoms, and preferably at least about 8 carbon atoms. The most preferred alcohols are lauryl, myristyl, cetyl, stearyl, and oleyl alcohols, and the said alcohols should be condensed with at least about 6 moles of ethylene oxide. A typical nonionic product is $C_{12}$–$C_{13}$ aliphatic alcohol condensed with about 6.5 moles of ethylene oxide. The corresponding alkyl mercaptans when condensed with ethylene oxide are also suitable in the compositions of the present invention.

The alkoxylated higher aliphatic alcohols are particularly well suited for home laundry detergent formulations because they are readily biodegradable and compatible with cationic surfactants and fabric softeners and with most other adjuvants.

It has been found that only two fabric softeners can be used in the highly concentrated single-phase detergent softener compositions according to the present invention: methyl (1) oleyl amido ethyl (2) oleyl imidazolinium methyl sulfate, and methyl (1) tallow amido ethyl (2) tallow imidazolinium methyl sulfate.

The 1-methyl-1-alkylamidoethyl-2-alkylimidazolinium methosulfate is generally obtained in concentration of 75% active ingredient in isopropanol. This is a low viscosity, clear liquid system. The 1-methyl-1-tallowamidoethyl-2-tallowimidazolinium methosulfate also is generally obtained in a concentration of 75% active ingredient in isopropanol. This system is a liquid at 80° F.

The fabric softeners for use in the present invention give fabrics a soft and fluffy feed while imparting good rewettability. These fabric softeners are substantive to fabric and help to reduce static cling and wrinkling making fabrics easier to iron and more comfortable to wear.

The solvent medium for the instant liquid detergent composition is an aqueous one, and may be water alone or may be substantially water with additional solvents added for particular ingredients. Because of the availability of water and its minimum cost, it is preferred to use water as the major solvent present. Yet, amounts of other solvents, generally up to 20%, and preferably a maximum of 15% of the total content, may be used. Generally, such a supplementing solvent will be either a lower alkanol or a lower diol or polyol, e.g., ethanol, isopropanol, ethylene glycol, propylene glycol, glycerol, or the like. Nevertheless, etheric polyols such as diethylene glycol and those known as cellosolves may also be used.

Various selected compatible adjuvants may be present in the liquid detergent composition to give it additional desired properties, either of functional or aesthetic nature. Thus, there may be included in the formulation: soil-suspending or anti-redeposition agents, e.g., polyvinyl alcohol sodium carboxymethyl cellulose, hydroxypropyl methyl cellulose, optical brighteners, e.g., cotton, amide, and polyester brighteners; preservatives, e.g., methyl parasept or sodium benzoate; ultraviolet absorbers, and perfumes. The adjuvants, of course, will be chosen to be compatible with the main constituents of the detergent formulation.

Of the adjuvants mentioned perhaps the most important for functional effect are the optical brighteners because the modern housewife has come to expect that washed clothing will no longer merely be clean and white but will also be bright in appearance. The optical brighteners are substantive to textiles being washed (such substantivity may be selective) and sometimes are of comparatively low solubilities. Accordingly, it is important that they be maintained in solution in the liquid detergent composition and, even more important, they must be immediately dispersed in the wash water so as to avoid producing a wash containing noticeable brightened spots, rather than a uniformly bright appearance. Here, the choice of brightener to obtain best results will be ascertainable to one of skill in the art. It has been found that relatively small quantities of brighteners should be used, so as not to exceed the limits of solubilities. Also, within the class of these materials certain brighteners have been found to be especially readily dissolved, and thus are suitable for incorporation in these products. Fortunately, such preferred brighteners include both cotton and amide-polyester-brighteners, making them suitable for use with laundries containing a variety of material and synthetic materials. Among the commercial brighteners that are used in the present system are Tinopal UNPC, Tinopal CBS (Ciba-Geigy), Arctic White CC (Hilton Davis), and the following Phorwhites from Verona: BKL, BUP, BBC solution, BRV solution, DCR liquid, DCBVF, EV liquid, DBS liquids, and ANR.

It was found that anionic tetrasulfonated stilbene type brighteners gave a better whitening effect than the disulfonated type of brighteners in combination with the cationic fabric softeners of the present invention. Specific examples of these disulfonated tetrasulfonated brighteners are Phorwhite BKL, BUP, BBU solution, and BRU solution.

Other types of optical brighteners which give superior whitening effects in combination with the cationic softeners of the present invention are those components having no sulfonate moieties. The preferred class of brighteners for use in the present invention include the 2-(4-styrylphenyl)-2H-naphtho[1,2-d] triazoles, 4,4'-bis(1,2,3-triazol-2-yl)stilbenes, 4,4'-bis(styryl) bisphenyls, and the 7-aminocoumarins. Specific examples of these brighteners include 4-methyl-7-diethylamino coumarin, 1,2-bis(benzimidazol-2-yl)ethylene, and the 1,3-diphenyl-phrazolines, as well as 2,5-bis(benzoxazol-2-yl) thiophene, 2-styryl-naphth [1,2-d] oxazole, and 2-(stilben-4-yl)-2H-naphtho[1,2-d]triazole.

The concentration ranges of the nonionic surfactant are from about 40% to about 70% by weight, with 60% being preferred. The concentration of the fabric softener is from about 15% to about 30% by weight, with about 21% being preferred. The aqueous solvent medium, preferably water, but which may also contain mono-, di-, and polyhydric alcohols and similar solvents, will range from about 5% to about 55% by weight. The optical brightener content of the liquid composition will normally be from about 0.2% to about 3.0%, and preferably from 0.25 to 2.7%. Such concentrations are soluble in the described liquid detergents and are effective in noticeably brightening the washed clothing.

The contents of the other adjuvants is preferably maintained at less than 5% by weight of the product. Use of more than the described proportions of the such compounds can often significantly change the properties of the liquid detergent, and therefore should be avoided.

Although the detergent softener composition of the present invention is a stable, clear one-phase liquid, a compatible opacifying agent may be added to impart a creamy appearance to the formulation.

Use of the present liquid detergent-softener is both simple and exceptionally efficient. As the formulation is extremely concentrated, very small amounts of liquid are employed, and the product can be used in both top loading and front loading washing machines. For example, using a typical formulation of the present invention, only about ⅛ cup of liquid is needed for a full automatic washing machine tub of wash, wherein the water volume is from 15 to 18 gallons. Correspondingly, only 1/16 cup is used when a front loading washing machine of about half the volume of the top loading machine. Thus, the concentration of liquid detergent in the wash water is only about 6 grams of softener and 18 grams of nonionic surfactant.

The wash water used may be a fairly soft water or water of reasonable hardness, and will generally be used at elevated temperature. The composition of the present invention is also useful in laundering clothes in very hard waters and at lower temperatures. Thus, water hardness may range from 0 to over 300 parts per million calculated as calcium carbonate, and washing temperatures may be from 40° to 120° F. Washing will be effected in an automatic washing machine in which the washing is followed by rinsing and spin or other draining or wringing cycles or operations. Of course, the detergent composition may also be used for hand washing of laundry, in which case it may sometimes be used full strength on certain stains on the laundry, or the laundry may be soaked in a higher concentration solution of detergent before washing.

The washing operations will generally take from three minutes to one hour, depending on the fabrics being washed and the degrees of soiling observed. After completion of washing and the spinning, draining or wringing operations, it is preferred to dry the laundry in an automatic dryer soon thereafter but line drying may also be employed.

The present detergent softener composition dissolves very easily in the wash water is warm or cold, and very effectively cleans, softens and eliminates static charge on clothing and other items of laundry without imparting a water repellant finish thereto. It may be used in either top loading or front loading washing machines and may be desirably adjusted to foam to the correct extent. The product is an attractive clear, stable liquid which maintains its activity and uniformity over a long shelf life. In tests in which the effects of using it are compared to those from the employment of commercial heavy duty laundry detergents, it is rated very favorably. It is often preferred for convenience of use because of its high concentration and elimination of a separate softening step; and excellent detergency, softening, anticling and rewettability properties are observed.

This product may be prepared by simply admixing the various ingredients at room temperature with agitation to ensure solubilization thereof in the aqueous medium. The order of addition of ingredients and the temperature of compounding may be varied without adversely affecting the formation of the single phase, clear liquid product of instant invention.

Where clear, one-phase liquids are desired, the concentrations of the active ingredients can be varied only with certain limits. Thus, the concentration of the softener cannot be much greater than 30% if a clear liquid is desired.

The liquid detergent-softener composition of the present invention exhibits many desirble characteristics which regard to both physical properties and performance in use. As to its physical properties, the compositions are pourable and free-flowing from the container as manufactured and after aging. They exhibit a high degree of stability upon storage at normal room temperature of the order of about 70° F. over a period of many months without any appreciable precipitation. As a result, the consumer can utilize them conventionally by addition of very small portions to a laundering bath, and the detergent and softener will be present in constant composition in each portion. While compatible adjuvant materials may be added to render the final product translucent or opaque as desired, the requirement for a one-phase solution of the main ingredients insures that effective washing and softening power will be obtained with each portion and promotes the stability and homogeneity of the product. The liquid may be packaged in any suitable container or packaging material such as metal, plastic, or glass.

DETAILED DESCRIPTION OF THE INVENTION

The following specific examples illustrate various embodiments of the present invention. It is to be understood, however, that such examples are presented for purpose of illustration only, and the present invention is in no way to be deemed as limited thereby.

EXAMPLE I

A detergent-softener composition was prepared by blending together the following ingredients:

| | % by weight |
|---|---|
| Neodol 23-6.5[$C_{12-13}$ ethoxylated (6.5EO) alcohol] | 60 |
| Methyl (1) oleyl amido ethyl (2) oleyl imidazolinium methyl sulfate 75% AI (Varisoft 3690, Ashland) | 26.7 |
| Water | 11.9 |
| Polar BrilliantBlue 0.5% solution | 0.4 |
| Perfume | 1.0 |

White cotton towels (16"×26" obtained from J. C. Penney & Co.) were washed for ten minute wash cycles in a General Electric washer in 17 gallons of tap water, having a hardness of 100 ppm, at 120° F, using ⅛ cup of the above detergent softener formulation. After being rinsed and air dried, the towels were rated for softness on a scale of 1=no softness to 10=excellent softness. The towels washed according to the above had a softness rating of 8 to 10, and appeared to be very clean.

The detergent formulation of Example I was compared with a conventional, less highly concentrated liquid detergent.

| | % by weight |
|---|---|
| Softened water | 10 |
| SD3A alcohol | 7 |
| Tinopal CBS** | 0.441 |
| Phorwhite BHC*** | 0.147 |
| Triethanolamine 9% AI | 0.474 |
| Na linear alkyl ($C_{10-13}$) benzene sulfonate | 14.238 |
| Neodol 23-6.5 | 33.319 |
| Sodium formate | 1.52 |
| Blue color solution | 0.3 |
| Perfume | 0.3 |
| Softened water | 32.261 |

**4,4'-bis[o-sulfostyryl]biphenyl
***4,4'-bis[4-phenyl 2H-1,2,3-triazol-2-yl]-2,2'-stilbene dipotassium sulfonate.

Soiled 3×4" cotton cloths were washed in a General Electric washer in 17 gallons of tap water, having a hardness of 100 ppm, at 120° F., for a ten minute wash cycle. After being rinsed and air dried, the reflectance values of the cloths were measured, expressed in Rd units. The results are tabulated below:

TABLE I

| | Reflectance values, Rd units | |
|---|---|---|
| | detergent of Example I | conventional detergent |
| | ⅛ cup | ¼ cup |
| Test fabric cotton | 41.4 | 38.2 |
| Clay on cotton | 68.6 | 64.3 |
| Clay on PE/cotton | 71.5 | 63.9 |
| EMPA cloth (soiled with olive oil and carbon black) | 22.7 | 21.7 |

Cloths washed according to the above in the detergent-softener formulation of Example I had a softness rating of 9, and evidenced no cling or static electricity buildup. Cloths washed in the conventional liquid detergent had a softness rating of 1, and evidenced both clinging and static buildup.

It can be seen from the above that the detergent formulation of Example I provides effective cleaning and softening while requiring the use of only half as much as conventional liquid detergents.

The detergent-softener composition was compared to the above-identified conventional liquid detergent in a standard mixed soil washing. Swatches of fabric, 3"×4" were subjected to standard soils and washed as above in water at 100° F. with a hardness of 100 ppm. The results are tabulated below:

TABLE II

| | Reflectance Values (Rd units) | |
|---|---|---|
| | Detergent of Example I | Conventional Liquid Detergent |
| Test fabric nylon | 45.9 | 64.5 |
| Test fabric cotton | 42.1 | 45.2 |
| Clay soil on cotton | 72.3 | 71.7 |
| Clay soil on polyester cotton PP | 73.7 | 64.3 |
| EMPA soil | 20.9 | 21.9 |

EXAMPLE II

A clear, one-phase liquid softener-detergent is prepared from the following:

| | % by weight |
|---|---|
| Tergitol 15-S-7[ethoxylated $C_{11}$—$C_{15}$ linear alcohols (7 moles EO)] | 50 |
| Methyl (1) oleyl amido ethyl (2) oleyl imidazolinium methyl sulfate 75% AI | 30 |
| Water | 18.6 |
| 2,5-bis(benzoxazol-2-yl)thiophene brightener | 0.4 |
| Perfume | 1.0 |

EXAMPLE III

A clear, one-phase liquid softener-detergent is prepared from the following:

| | % by weight |
|---|---|
| Neodol 23-6.5 | 55 |
| 1-methyl-1-tallowamidoethyl-2-tallowimidazolinium methosulfate, 75% AI | 26 |
| Water | 13 |
| Isopropanol | 5 |
| Tinopal CBS | 0.5 |
| Perfume | 0.5 |

EXAMPLE IV

An opaque one-phase liquid softener-detergent is prepared from the following:

| | % by weight |
|---|---|
| Tergitol 15-S-7 | 60 |
| 1-methyl-1-tallowamidoethyl-2-tallowimidazolinium methosulfate, 75% AI | 30 |
| Water | 4.7 |
| Propylene Glycol | 3 |
| Castor wax | 1 |
| Polar brilliant blue, 1.5% solution | 0.3 |
| Perfume | 1.0 |

This composition is effective for cleaning and softening when used in concentrations of ⅛ cup per full washload.

EXAMPLE V

A clear, one-phase liquid softener-detergent is prepared by blending together the following ingredients:

| | % by weight |
|---|---|
| Tergitol 25-L-9 ($C_{12}$—$C_{15}$ ethoxylated (9 moles EO) linear alcohol) | 70 |
| Methyl (1) oleyl amido ethyl (2) oleyl imidazolinium methyl sulfate 75% AI | 25 |
| Water | 4 |
| Perfume | 0.55 |
| Tinopal CBS | 0.45 |

This composition is effective when used in concentrations of ⅛ cup per full washload.

EXAMPLE VI

A clear, one-phase liquid softener-detergent is prepared by blending together the following ingredients:

| | % by weight |
|---|---|
| Neodol 23-6.5 | 60 |
| 1-methyl-1-tallowamidoethyl-2-tallowimidazolinium methosulfate, 75% AI | 20 |
| Water | 16 |
| Propylene glycol | 2 |
| Perfume | 1 |
| 2,5-bis(benzoxazol-2-yl) thiophene | 1 |

What is claimed is:

1. A single-phase liquid detergent-softener composition comprising:
   (a) from about 40% to about 70% by weight nonionic surfactant;
   (b) from about 15% to about 30% by weight of a softener selected from the group consisting of methyl (1) oleylamido ethyl (2) oleyl imidazolinium methyl sulfate and 1-methyl-1-tallowamido-ethyl-2-tallowimidazolinium methosulfate;
   (c) a solvent.

2. The detergent-softener composition of claim 1 wherein the softener is methyl (1) oleyl amido ethyl (2) imidazolinium sulfate methyl.

3. The detergent-softener composition of claim 2 wherein the softener is present in an amount of 21% by weight.

4. The detergent-softener composition of claim 3 wherein the nonionic surfactant is present in the amount of 60% by weight.

5. The detergent-softener composition of claim 2 wherein the nonionic surfactant is an ethoxylated linear aliphatic alcohol.

6. The detergent-softener composition of claim 5 wherein the nonionic surfactant is a $C_{12}$–$C_{13}$ alcohol ethoxylated with 6.5 moles of ethylene oxide.

7. The detergent-softener composition of claim 1 including a compatible optical brightener.

8. The detergent-softener composition of claim 1 wherein the solvent is water.

9. The detergent-softener composition of claim 1 wherein the solvent is a mixture of water and a solvent selected from the group consisting of water-soluble lower alkyl monohydric alcohols, dihydric alcohols, and polyhydric alcohols.

* * * * *

UNITED STATES PATENT AND TRADEMARK OFFICE

CERTIFICATE OF CORRECTION

PATENT NO. : 4,140,641

DATED : February 20, 1979

INVENTOR(S) : Pallassana Ramachandran

It is certified that error appears in the above-identified patent and that said Letters Patent are hereby corrected as shown below:

In Claim 2, second line, after "(2)", insert --oleyl--; third line, "sulfate methyl" should read --methyl sulfate--.

Signed and Sealed this

*Sixth* Day of *January 1981*

[SEAL]

*Attest:*

SIDNEY A. DIAMOND

*Attesting Officer*

*Commissioner of Patents and Trademarks*